US005243578A

United States Patent [19]

Mathez

[11] Patent Number: 5,243,578

[45] Date of Patent: Sep. 7, 1993

[54] ELECTRONIC TIMEPIECE

[75] Inventor: Bernard E. Mathez, La Chaux-de-Fonds, Switzerland

[73] Assignee: Lemrich & Cie S.A., La Chaux-de-Fonds, Switzerland

[21] Appl. No.: 751,647

[22] Filed: Aug. 26, 1991

Related U.S. Application Data

[63] Continuation of Ser. No. 578,356, Sep. 6, 1990, abandoned.

[30] Foreign Application Priority Data

Sep. 26, 1989 [CH] Switzerland ..... 3487/89

[51] Int. Cl.[5] ..... G04C 23/02; G04B 1/00

[52] U.S. Cl. ..... 368/88; 368/205

[58] Field of Search ..... 368/203-205, 368/88, 76, 276, 299-300

[56] References Cited

U.S. PATENT DOCUMENTS 4,068,464 1/1978 Barnett et al. ..... 368/204
4,240,021 12/1980 Kashima et al. ..... 368/205
4,261,049 4/1981 Komiyama et al. ..... 368/205
4,296,489 10/1981 Mitsui ..... 368/205
4,477,195 10/1984 Saitoh et al. ..... 368/204
4,666,313 5/1987 Ganter et al. ..... 368/205

*Primary Examiner*—Vit W. Miska
*Attorney, Agent, or Firm*—Kane, Dalsimer, Sullivan, Kurucz, Levy, Eisele and Richard

[57] ABSTRACT

It comprises a standard electronic movement (13) held in the case (1) by means of an encasing ring (15) made of synthetic material and also containing a large-sized accumulator (30) gripped between two conductive plates (16, 29). The upper plate (16) is covered with an insulating film (18) pierced with a hole (19), through which the blade (14) of the battery receptacle of the movement comes in contact with the plate (16). The other pole of the accumulator is connected to the movement by means of the base (3), the case (1) and the dial (10). The encasing ring (15) carries photovoltaic cells (21) illuminated through indentations (22) of the dial. The timepiece can advantageously be produced in small series, and its power reserve is very high.

4 Claims, 1 Drawing Sheet

ELECTRONIC TIMEPIECE

This is a continuation of copending application Ser. No. 07/578,356 filed on Sep. 6, 1990 now abandoned.

FIELD OF THE INVENTION

The subject of the present invention is an electronic timepiece with an analog display, comprising a case equipped with a glass and containing a dial, an electronic movement, the metallic lower face of which is connected electrically to one of the supply terminals of the electronic circuit, with the exception of a metal blade connected electrically to the other supply terminal, this movement being held in the case by means of an encasing ring made of insulating synthetic material, an accumulator for supplying the movement and photovoltaic cells for charging the accumulator.

PRIOR ART

The highly automated production of electronic timepiece movements with a quartz oscillator and stepping micromotor makes it possible nowadays to produce watches at highly competitive prices by using any of the movements available on the market. These movements comprise a battery receptacle, the bottom of which has an elastic metal blade making the electrical connection between one of the poles of the battery and the electronic circuit of the movement, the other electrical connection being made by the metal housing of the movement.

It has already been proposed to replace the battery with a rechargeable accumulator, the charging of which is obtained by means of photovoltaic cells mounted on the case or strap. However, the battery receptacle makes it possible to accommodate only a battery of small size, that is to say of low capacity, providing the movement with only a short power reserve. Thus, if the watch is kept for too long in the dark or in a place with too little light, the power reserve proves inadequate. To overcome this inadequacy, it would be possible to construct a new movement which would have a larger battery receptacle making it possible to accommodate an accumulator of higher capacity and in which the diode and the filter capacitor of the accumulator charging circuit would be integrated. However, such a solution requires an execution which is highly costly and which is therefore out of the question for small series.

SUMMARY OF THE INVENTION

The object of the invention is to provide a timepiece, especially electronic with a supply by photovoltaic cells having a high power reserve, capable of being produced at low cost, even in small series, that is to say by using movements available in large quantities on the market.

The electronic timepiece according to the invention is defined in that the case is made of metal or contains a metal container, in that the accumulator is accommodated under the movement in the encasing ring, and in that the upper face of the accumulator confronting the movement is insulated from the movement by means of an insulating film, through which only the said metal blade of the movement passes, and in that the photovoltaic cells and the components of the electrical circuit connecting the photovoltaic cells to the accumulator are mounted on the encasing ring, cutouts being provided in the dial opposite the photovoltaic cells.

The encasing ring is therefore used at the same time as a receptacle for the accumulator, the diameter of which can be at least as large as the largest dimension of the movement. The capacity of such an accumulator can be considerable.

Commercial movements can be used without any modification, the existing contact blade simply being bent to a greater extent, so as to project outside the movement in order to make contact with the accumulator through a hole in the insulating film.

To make the production of the timepiece easier, the accumulator is preferably mounted between two thin metal plates, to which are welded the terminals of the diode and one of the terminals of the capacitor of the charging circuit of the accumulator.

The assembly is held elastically under pressure by the base of the case which is removable or not.

If it is desirable to use a case made of synthetic material, the movement together with its metal dial, the encasing ring and the accumulator will be accommodated in a metal container, itself accommodated in the case made of synthetic material.

The invention is especially useful for producing a wrist watch, but can also be used for carriage clocks and large clocks.

BRIEF DESCRIPTION OF THE DRAWINGS

The accompanying drawing illustrates one embodiment of the invention by way of example.

DESCRIPTION OF THE PREFERRED EMBODIMENT

Figure 1:
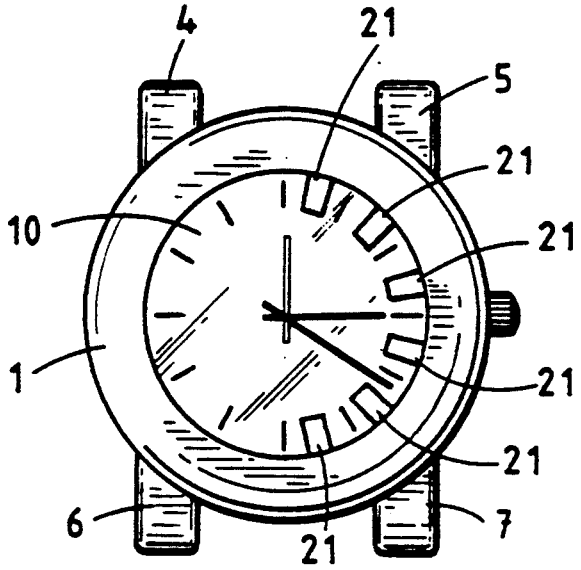
FIG. 1 is a plan view of a wrist watch.
Figure 2:
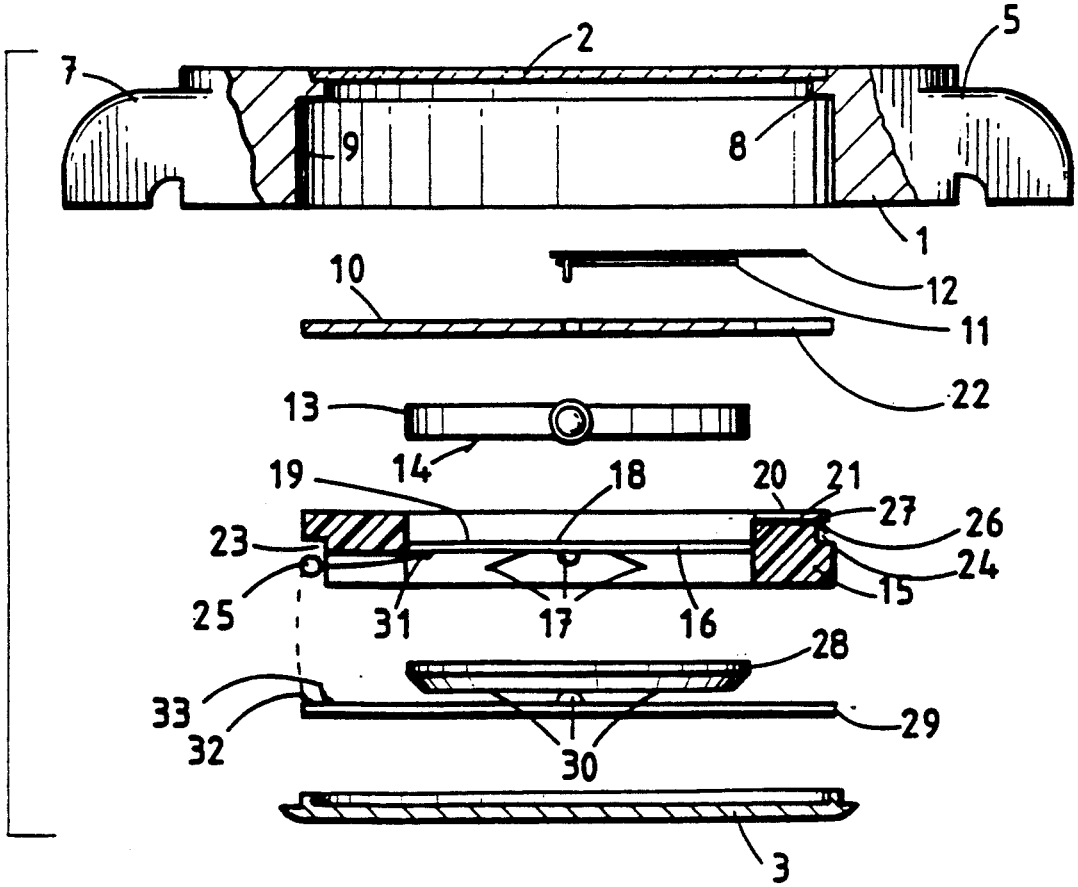
FIG. 2 is an exploded view partially in axial section.

The watch illustrated comprises a case consisting of a metal bezel 1, of a glass 2 fastened in a glass notch of the bezel 1 and of a metal base 3 notch-fastened in the bezel 1. The bezel 1 is equipped with two pairs of horns 4, 5 and 6, 7 for fastening a strap. Underneath the glass notch, the bezel 1 has a bearing surface 8, the rest of the interior of the bezel consisting simply of a cylindrical face 9.

Located immediately below the glass 2 is a metal dial 10 which bears against the bearing surface 8, leaving a sufficient space for the hands 11 and 12 of an electronic movement 13 laid against the lower face of the dial 10. The movement 13 is any commercial movement, for example a $6\frac{3}{4}\times 8$ movement. Such a movement has a battery receptacle, in which a contact blade 14 is located. Here, this blade 14 is bent downwards so as to project outside the metal housing of the movement. This movement is accommodated in an encasing ring 15 made of synthetic material, the outside diameter of which is equal to the diameter of the dial 10, that is to say to the inside diameter of the bezel 1. Inside the encasing ring 15, at a level corresponding to the thickness of the movement 13, there is a metal plate 16, in which elastic blades 17 directed downwards are cut out. The upper face of the metal plate 16 is covered with an insulating film 18 which, however, has a hole in the zone 19 located opposite the blade 14 of the movement. The encasing ring 15 possesses, under its upper face, a particular number of indentations 20, in each of which a photovoltaic cell 21 is accommodated. The dial 10 is likewise equipped with indentations 22 of a number equal to the number of indentations 20 and arranged respectively opposite each of the indentations 20, in such a way that the photovoltaic cells are visible. As can be seen in FIG. 1, the photovoltaic cells 21 number six arranged between the hour marks of the dial. The periphery of the encasing ring 15 has clearances and grooves, such as 23, 24, for receiving the diode 25 and the capacitor of the charging circuit of the accumulator and for the passage of the conductor wire 26 connecting the photovoltaic cells to one another and to the capacitor. One of the spots 27 welded in the conductor wire to one of the photovoltaic cells 21 has been shown. It will be seen that this welding spot 27 is concealed by the bearing surface 8.

The inner part of the ring 15 located underneath the metal plate 16 forms a receptacle for an accumulator 28 in the form of a circular chip. Located under this accumulator is a second metal plate 29 similar to the plate 16, but of a diameter equal to the outside diameter of the ring 15. This plate 29 is likewise equipped with cut-out elastic blades 30 which bear against the lower face of the accumulator 28. The terminals of the diode 25 are welded respectively to the plate 16 at 31 and to the plate 29 at 32. One of the terminals of the capacitor is welded to the plate 29 at a point 33 near the point 32.

The dial 10, the encasing ring 15 with the movement and accumulator and the metal plate 29 are held bearing elastically against the bearing surface 8 of the bezel by means of the base 3. The electrical contacts are made by the elastic blades 14, 17 and 30 and by the base 3, bezel 1 and dial 10.

In practice, before assembly, the watch consists only of the following four components: the bezel 1 with its glass 2, the movement 13 with the dial 10 and hands, the ring 15 with the accumulator 28 between the plates 16 and 29, and the base 3. Assembly is carried out simply by introducing the second and third components into the bezel successively or simultaneously and then by securing the base.

If the conductivity of the bezel 1 is insufficient, this can be remedied by providing a cylindrical conductive collar or sleeve ensuring contact between the dial and the base.

The components of the watch could also be mounted in a cup-shaped case, that is to say one where the base is unremovable.

The diode and capacitor, instead of being mounted on the periphery of the encasing ring 15, could be seated in recesses provided on the upper face or lower face of the ring.

The photovoltaic cells could at the same time form the hour marks of the dial.

I claim:

1. An electronic analog time piece comprising:
a case equipped with a glass and containing a dial;
an integrally formed annular ring made of an insulating and synthetic material, disposed in said case, said ring having a cylindrical inner wall defining a substantially cylindrical space;
an insulating film partitioning said space into a first and a second chamber, said insulating film having an access hole;
a movement disposed in said first chamber, said movement having hands movable across said dial for indicating time and a connecting blade;
an accumulator disposed in said second chamber and in contact with said movement through said connecting blade;
photovoltaic cells mounted on said ring for charging said accumulator;
an electrical circuit connecting said cells to said accumulator;
said dial having cutouts opposite said photovoltaic cells; and
a base disposed under said accumulator and attached to said case.

2. The timepiece as claimed in claim 1, wherein said movement has a metal housing having a polarity different from that of said blade, wherein an electrical connection between a lower face of the accumulator and said metal housing is made through said base.

3. The timepiece as claimed in claim 2, in which the electrical circuit between the photovoltaic cells and the accumulator comprises a diode, wherein the accumulator (28) is gripped between two metal contact plates (16, 29), one (16) of which is fastened in the encasing ring (15), the terminals of the diode (25) being welded respectively to each of these plates.

4. The timepiece as claimed in claim 3, wherein the said metal plates (16, 29) are equipped with elastic contact blades (17, 30).

* * * * *